United States Patent [19]

Barbour

[11] 4,248,171

[45] Feb. 3, 1981

[54] ANCHOR HANDLING AND SECURING ASSEMBLY

[76] Inventor: Robert G. Barbour, 10597 Ayres Ave., Los Angeles, Calif. 90064

[21] Appl. No.: 53,982

[22] Filed: Jul. 2, 1979

[51] Int. Cl.[3] ..... B66D 1/24

[52] U.S. Cl. ..... 114/210; 114/301

[58] Field of Search ..... 9/1.1, 1.7, 400; 114/210, 221 R, 293, 294, 310, 301

[56] References Cited

U.S. PATENT DOCUMENTS

| | | | |
|---|---|---|---|
| 2,203,390 | 6/1940 | Maxwell | 114/294 X |
| 2,605,082 | 7/1952 | Alderson et al. | 114/210 X |
| 3,082,730 | 3/1963 | Good | 114/210 |
| 3,439,644 | 4/1969 | Pennington | 9/1.7 X |
| 3,804,051 | 4/1974 | Norton | 114/210 |
| 3,834,670 | 9/1974 | Pityo | 114/210 X |
| 3,865,065 | 2/1975 | Dennis et al. | 114/210 |

*Primary Examiner*—Trygve M. Blix
*Assistant Examiner*—D. W. Keen
*Attorney, Agent, or Firm*—Poms, Smith, Lande & Rose

[57] ABSTRACT

An assembly is provided for raising and lowering, and for firmly securing, a type of anchor known as a "Bruce" anchor. The assembly includes the rear channel shaped section for receiving the shank of the anchor when it is stowed, and for mounting the assembly on the front deck of the boat. The assembly also includes a forwardly extending section having two side plates which have a roller mounted between them for raising and lowering the anchor over the front portion of the deck of the boat. The roller may be of high strength plastic such as Delrin, and is fairly large, being in the order of 5 inches in diameter and about 3 or 4 inches in width and deeply grooved to receive and center the chain or rope by which the anchor is raised and lowered, and also for engaging the L-shaped shank of the anchor when it is stowed. The front portion of the assembly also includes two protrusions for engaging the fluke area of the Bruce anchor. In addition, the roller is mounted for movement upwardly and to the rear, as the anchor is pulled up and into the assembly with the main shank of the anchor extending along the channel shaped rear portion of the assembly, so that the anchor is held firmly by the protrusions, and the engagement by both the main portion of the shank and the forward or crown portion of the shank with the roller, as the roller shifts upward and to the rear.

11 Claims, 5 Drawing Figures

ANCHOR HANDLING AND SECURING ASSEMBLY

FIELD OF THE INVENTION

The present invention relates to apparatus for raising and lowering, and for the storing or securing of anchors, particularly anchors of the "Bruce" type.

BACKGROUND OF THE INVENTION

In connection with the background of the present invention, a brief review of the history of anchors is appropriate. First, the earliest forms of anchors involved a simple weight, such as a heavy rock tied with a rope, or the like. Subsequently, anchors were designed with structures for digging into the bottom of a body of water. These included mushroom type anchors and anchors with flukes, or pointed members which would dig into the ground. Further, in order to orient the flukes so that they would dig into the ground and not merely lie flat on the bottom of the body of water, cross pieces, known as "stocks" were attached to the bottom of the anchor crosswise to the flukes. Accordingly, the anchor normally included the flukes, an extended shank to which the ship or vessel's cable was attached and a cross piece or stock to maintain the fluke or flukes in the proper orientation to dig into the bottom of the body of water. Normally, it is desirable to use a length of cable which is equal to 6 or more times the depth of the water where the vessel is being anchored. When the shank of the anchor is pulled substantially horizontally, the flukes will then dig in to the bottom of the body of water and hold the vessel against movement.

One of the problems which arose in the use of these relatively complicated anchor structures was the matter of storing the anchors so that they could be deployed quickly and easily. In view of the complicated structure including the shank, the pointed flukes, and the cross piece or stocks which were employed, the resultant structure was awkward, cumbersome, and difficult to store. One solution which was developed was the so-called "stockless" anchor which included two flukes which were pivoted together, relative to the shank of the anchor so that when the anchor was initially lowered, the entire structure could lie flat on the bottom of the ocean, with the pair of flukes pointing back along the shank of the anchor from the pivot region at the far end or "crown" of the anchor. The pair of flukes was capable of pivoting up to about 30 or 40 degrees in either direction from the shank, and when tension was applied to the shank of the anchor, the flukes would dig in and hold the anchor against movement. On the other hand, when the cable to the vessel was shortened, the flukes would be tilted upward and out of the earth or sand at the bottom of the ocean so that the anchor could be freely raised. Further, the relatively flat structure of the "stockless" anchor permitted easier storage, for example, against the outer surface of the hull of a large ship, when the shank of the anchor was pulled up into the "Hawsepipe" through which the chain was drawn into the vessel by a winch or the like.

Another popular anchor which has a relatively low weight to holding power ratio is the plow type anchor, also known as the C.Q.R. anchor. This includes a single plow-shaped fluke or holding member which is pivoted relative to the shank so that, when the shank is pulled horizontally, the plow digs into the bottom of the body of water.

In the last decade, a new form of anchor, known as the Bruce anchor, has started to enjoy considerable popularity. It has a very low weight to holding power ratio, and also has the advantage over the stockless and the C.Q.R. or plow anchors that it has no hinge or pivot structure which can become fouled or entangled with the anchor cable. The Bruce anchor has an L-shaped shank with the shorter leg of the L at the crown or most remote portion of the anchor. Extending back generally parallel to the longer portion of the shank is a large shovel-shaped fluke, and two smaller curved flukes curve outward and up toward the end of the main shank on either side of the large area central fluke. The broad area at the base of the flukes has a passing correspondence to the palm of a persons' hand, and is therefore occasionally referred to as the palm or the fluke area of the anchor. As noted above, the Bruce anchor is a very efficient anchor for its weight; unfortunately, however, with its rigid and extended structure, it is relatively awkward to store.

Accordingly, a principal object of the present invention is to provide an arrangement for not only raising and lowering anchors of the Bruce type, but also for securing them when the vessel is under way.

SUMMARY OF THE INVENTION

In accordance with the present invention, an assembly is provided for both raising and lowering anchors of the Bruce type and also for securing them when the vessel is under way. The apparatus includes a frame having a rear portion for mounting on a vessel and for guiding the shank of a Bruce anchor, and a front portion extending over the water and including both a pulley wheel and also protruding elements for engaging the palm or fluke area of the Bruce anchor so that when the main shank of the anchor is pulled over the pulley wheel, the protrusion elements engage the lower portion of the anchor in the vicinity of the flukes and firmly secure it in position.

In accordance with a collateral aspect of the invention the pulley is movable from a lower forward position to a higher rear position when the anchor is pulled back into the assembly and the front or crown portion of the L-shaped shank of the anchor engages the pulley wheel. This movement of the pulley insures firm seating and securing of the various size Bruce anchors and also of a single size anchor despite wear or slight variations in dimensions.

In accordance with subordinate features of the invention, the rear portion of the frame may be channel shaped, and the forward portion may include two parallel plates; with the pulley wheel mounted in a pair of angled slots in the two plates; the protrusion elements may be the lower front corners of the forwardly extending members of the frame; and the pulley wheel may be a deeply grooved, high strength plastic such as Delrin. Other materials, including metals and composites could also be used.

It is noted that the present assembly has several advantages. First, the pulley wheel has the advantage of permitting easy raising and deployment of the anchor, and this is accomplished without marring the deck or other surfaces of the vessel. Further, as the main shank of the anchor passes over the roller, the weight of the flukes properly orients the anchor for engagement with the protrusion elements. In addition, the pulley with its center of rotation movable as it is engaged by the crown or forward portion of the shank, not only performs the foregoing functions, but also serves to compensate for variations in the distance between the flukes and the main shank of the anchor for different size anchors. Finally, when the anchor is secured, it is firmly constrained against all movement, including vertical and rocking motion.

Other objects, features, and advantages of the invention will become apparent from a consideration of the following detailed description and from the drawings.

DETAILED DESCRIPTION

Figures 1, 2, 3, 4, 5:
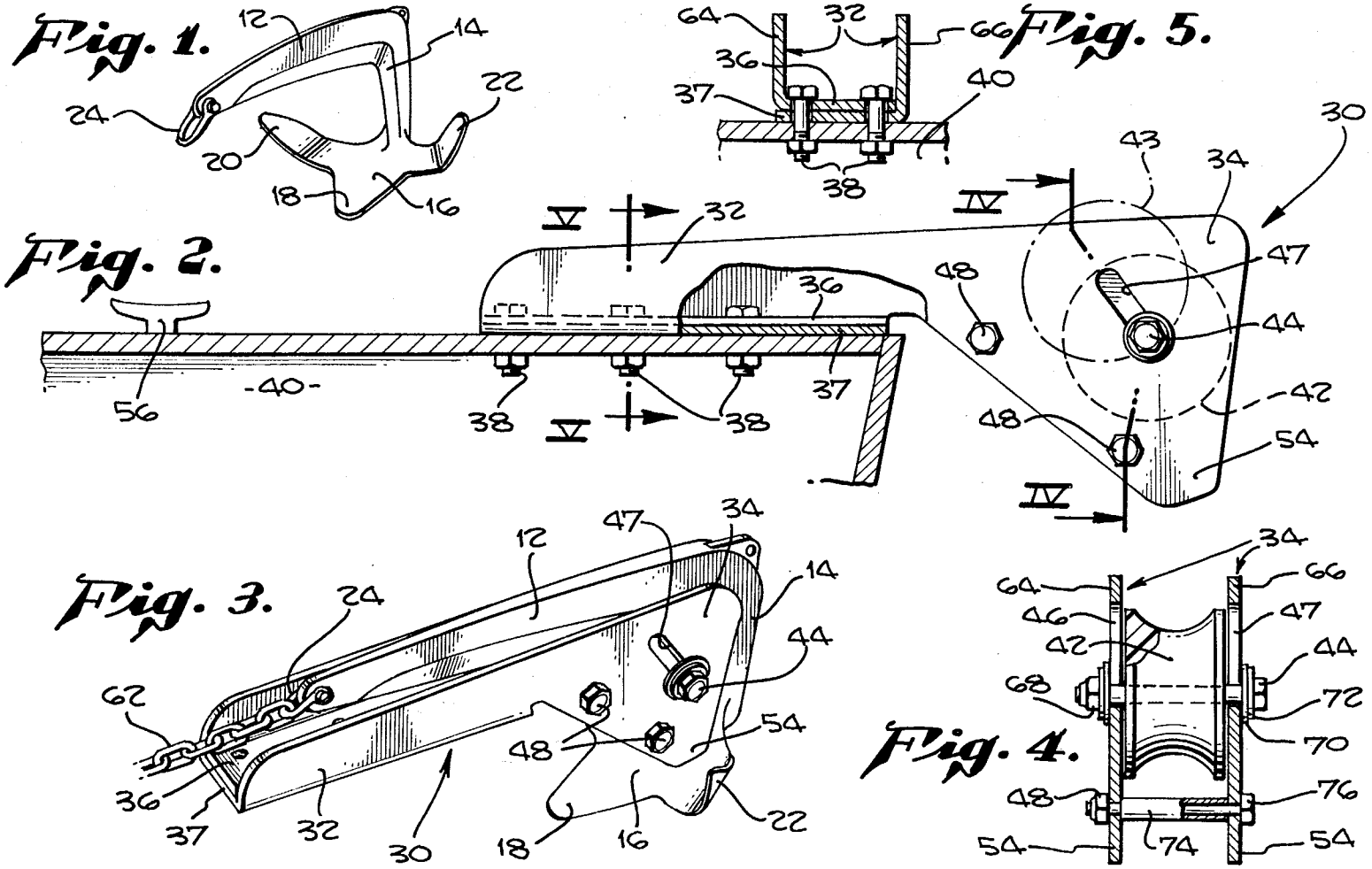
FIG. 1 is an isometric view of a Bruce anchor.
FIG. 2 is a side view of an assembly illustrating the principles of the invention, showing one possible arrangement for mounting it on a vessel.
FIG. 3 is an angular view showing a Bruce anchor mounted on the assembly of FIG. 2.
FIG. 4 is a partial cross-sectional view taken along lines IV—IV of FIG. 2.
FIG. 5 is a cross-sectional view taken along lines V—V of FIG. 2.

Referring more particularly to the drawings, FIG. 1 is an angled view of a Bruce anchor. The anchor includes a main shank portion 12, a shorter forward or crown portion of the shank 14, which is normally about ½ of the length of the main portion 12, and the palm or fluke area 16. The Bruce anchor has three flukes, a main central fluke 18 which is relatively stubby and broad in area and two upwardly curved side flukes 20 and 22. The anchor may be secured to a cable by the shackle or clevis 24.

In practice, when the anchor is first lowered, it may lie over on its side, on the long main shank 12 and on the point of one of the laterally extending flukes 20 or 22. However, as the cable is extended from the vessel, and as horizontal pressure is applied to the shackle 24 and thus to the elongated shank 12, the tips of the side flukes 20 which extend back along the main shank 12 to some extent, dig in somewhat and exert a rotating force on the assembly to turn the anchor so that the central fluke 18 engages the ocean floor, or the bottom of other bodies of water, and it, as well as the lateral flukes 20 and 22 will dig into the floor of the body of water.

It is said that a ten kilogram, or 22 pound Bruce anchor has the equivalent holding power of a 35 to 40 pound plough type anchor. Accordingly, because of its very light weight, it has become quite popular. On the other hand, its relatively complex shape with its extending flukes makes it somewhat awkward and difficult to store within the limited confines of a vessel.

Consideration will now be given to FIGS. 2, 3 and 4 which show an assembly for raising, lowering and securing Bruce type anchors. FIG. 2 is a side view of the assembly 30, including a rear section 32 and a forward portion 34 which extends over the water when the unit is installed on a vessel. More specifically, the rear section 32 includes two L-shaped frame members having lower overlapping portions 36, 37 as shown by dashed lines in FIG. 2. The rear section 32 has a U-shaped cross section, open at the top, and the two L-shaped frame members have side plates which continue to form the side members of the forward section 34. Heavy screws or bolts 38 extend through matching holes in the overlapping lower elements of the rear frame portion 32 to hold the assembly firmly to the vessel, a portion of which is shown at reference numeral 40.

A pulley roller 42 is mounted between the two plates forming the forward portion 34 of the assembly 30. The pulley wheel 42 is mounted on a bolt 44 which is slidably mounted in slots, one of which designated 46 is shown in FIG. 2. The raised position of the roller 42 is indicated by the dashed lines 43 in FIG. 2.

The additional bolts 48 are provided with spacer tubes between the two side plates forming the front section 34 of the assembly, and their nuts are provided with suitable locking arrangements, such as nylon inserts, to insure permanent locking action, so that the nuts will not drop off with vibration or the like. Similarly, the bolt 44 is provided with a metal and plastic washer on each side of the side plates and a similar locking nut with a nylon insert on one side to provide sufficient clearance for free rotation of the roller 42, while insuring retention of the bolt.

As described in greater detail below, the anchor when it is raised initially has the main shank 12 (see FIG. 1) brought up over the roller 24, either by winching or through manual force, and the flukes will then swing around so that they are below the protrusions 54 at the lower forward point of the assembly. Then, as the cable for the anchor is pulled and the shank is brought aboard and extends parallel to the channel-shaped rear portion 32 of the assembly 30, the shorter crown portion 14 of the shank will engage the front of the roller 42, and with continued inboard force, the roller 42 will shift in the slots 46 until the palm or fluke area 16 of the anchor engages the protrusions 54. Continued force exerted by the winch or other suitable locking arrangements such as a cleat 56 will hold the Bruce anchor firmly in place with the roller engaging both of the portions 12 and 14 of the shank, and the protrusions 54 engaging the fluke area.

FIG. 3 is an angular view showing the assembly 30 securing a Bruce anchor with the chain or anchor cable 62 in tension and pulling the main shank 12 of the anchor in general alignment with the rear, channel-shaped frame section 32 of the assembly 30. The reference numerals employed in FIG. 3 correspond to those of FIGS. 1 and 2. Incidentally, in the showing of FIG. 3 the fluke 22 appears to be very small because the view is taken very nearly along this fluke 22.

FIG. 4 is taken along lines IV—IV of FIG. 2 through the roller 42. In considering FIG. 4, it may be noted that the front section 34 of the assembly 30 includes the two side plates 64 and 66. As mentioned above and as shown in FIGS. 2 and 5, toward the rear of the assembly 30 in the rear section 32, a portion of each of the plates is bent over to form a U-shaped channel from the two L-shaped members with the lower portions 36, 37 overlapping one another. Returning now to FIG. 4, the roller 42 is mounted in the slots 46 and 47 in the side plates 64 and 66, respectively. The pulley wheel 42 is mounted on the bolt 44 so that the pulley wheel is freely rotatable. More specifically, the locking nut 68 at one end, and the head of the bolt 44 at the other end are mounted with sufficient clearance so that the pulley 42 does not bind. Further, a pair of plastic washers 70 and steel washers 72 contribute to the free rotation of the bolt 44 and the pulley 42 relative to the side plates 64 and 66. The pulley is grooved, preferably centrally, to align the cable or chain in the course of raising or lowering the anchor and also to align the longer shank portion 12 and the shorter shank portion 14 of the anchor to insure proper securing of the anchor in position as indicated in FIG. 3. The bolts 48 are provided with spacer tubes 74 to accurately space the plates 64 and 66 apart by the desired distance. The plates are held into firm engagement with the spacer tubes 74 by tightening the lock nuts, such as the nut 76 up firmly against the side plate 66.

As shown in FIG. 5, taken along lines V—V of FIG. 2, the plates 64 and 66 extend to the rear section 32 of the assembly, which serves the securing and guiding functions mentioned hereinabove.

Concerning the size of the Bruce anchors which may be accommodated by the present assembly, the nominal weight of the anchors under consideration range from approximately 10 kilograms or 22 pounds up to 30 kilograms or 66 pounds. The intermediate sizes of 15 and 20 kilograms, or 33 and 44 pounds, are also accommodated, as mentioned hereinabove. For this range of anchor weights, the size and dimensions of the assembly are approximately as follows. The Delryn roller has a maximum diameter of five inches at its edges, and a diameter of approximately 3½ inches at the bottom of its groove. The side plates are spaced apart approximately 3½ inches, and the plates forming the sides and the frame are approximately 3/16 inch thick stainless steel. The slots for the roller are about three inches long. The unit is approximately twenty-three inches long. The rear section is approximately three inches high, and the height of the front section from the protrusions 54 to the upper edge of the plates 64 and 66 is approximately 9 inches. It is to be understood that the dimensions may be varied to suit the mounting conditions, the size of the anchors to be accomodated and other factors.

In conclusion, it is to be understood that the present invention is not limited to the structure precisely as illustrated. Thus, by way of example and not of limitation, the pulley wheel 42 could be mounted on a pair of pivoting arms to move in much the same direction, or could be mounted in a track; the entire assembly could be mounted at a different angle, for example, on a bowsprit or on a block of wood, instead of horizontal on the deck as indicated by FIG. 2; and the anchor cable could take the form of a nylon rope or line, a wire rope, or an old-fashioned rope hawser, instead of the chain as shown in FIG. 3; instead of the cleat shown in FIG. 2 for maintaining the anchor cable under tension, a winch or windless could be employed; suitable resilient elements or bumpers could be employed in the structure; the protrusions or other means for engaging the lower portion of the anchor could be movable relative to the roller rather than vice cersa; and instead of protrusion 54, other elements, including a pair of bifurcated extensions for engaging both sides of the flukes 20 and 22 could be used. Also, the assembly could be used to raise and lower, and to store anchors of irregular configurations other than the Bruce anchor. Accordingly, the present invention is not limited precisely to that shown in the accompanying drawings and described in the associated detailed description.

What is claimed is:

1. An assembly for the raising and lowering of anchors of the Bruce type and for the firm securing of different size Bruce anchors when they are not being used, where the Bruce anchors include an L-shaped shank having a main longer shank portion, a shorter crown portion of the shank, and a palm or fluke area secured to the extreme outer end of the crown portion of the shank, said assembly comprising:

a frame having a rear channel shaped section for securing to the deck or other structure of a vessel and for receiving the main shank of the anchor, and a forward section having side members for extension beyond the vessel, said side members including protrusion means for receiving and firmly engaging the fluke area of the Bruce anchor;

means including a pulley wheel mounted between said side members on the forwardly extending section of said frame for guiding the cable for the anchor as it is raised and lowered, and for engaging both the main portion of the shank of the anchor and also the forward portion of the shank near the crown of the anchor when the main shank of the anchor is pulled firmly back along said rear channel shaped section; and said assembly including means for movably mounting said pulley wheel to locations having different distances from said protrusion means to firmly secure different sizes of Bruce anchors with the main shank of each anchor extending along the rear channel, the protrusion means engaging the fluke area of each anchor and the pulley engaging both the main and the crown portion of the shank of the anchor near its crown;

whereby said assembly facilitates the raising and lowering of the anchor, and firmly secures Bruce anchors of a series of different sizes, with fluke or palm area engaged by said protrusions and both the longer and shorter portions of said shank engaged by said roller so that the anchor is held against rolling or vibrating under conditions of movement or vibration.

2. An assembly as defined in claim 1 wherein said pulley wheel mounting means includes a pair of aligned slots in said forwardly extending side members, said slots extruding upward and to the rear, away from said protrusions.

3. An assembly as defined in claim 1 wherein said pulley wheel includes a grooved outer surface.

4. An assembly as defined in claim 1 wherein said pulley wheel is made of high strength plastic.

5. An assembly as defined in claim 1 wherein said frame is made of a pair of left and right hand sheet metal members, each being substantially flat in the forward section and being of overlapping L-shaped configuration in the rear section.

6. An assembly as defined in claim 1 including means for causing engagement of pulley wheel with both the main portion and the front crown portion to move said pulley as the shank of the anchor is drawn into the assembly.

7. An assembly as defined in claim 1 wherein said movable mounting means for said pulley includes slots in said side members of said frame extending upward and to the rear away from said protrusions at an acute angle, and a pivot shaft for said roller mounted in said slots.

8. An assembly for the raising and lowering of anchors of the Bruce type and for the firm securing of different size Bruce anchors when they are not being used, where the Bruce anchors include an L-shaped shank having a main longer shank portion, a shorter crown portion of the shank, and a palm or fluke area secured to the extreme outer end of the crown portion of the shank, said assembly comprising:

a frame having a rear section for securing to the deck or other structure of a vessel and for receiving the main shank of the anchor, and a forward section having side members for extension beyond the vessel;

means including a pulley wheel mounted between said side members on the forwardly extending section of said frame for guiding the cable for the anchor as it is raised and lowered, and for engaging both the main portion of the shank of the anchor and also the forward portion of the shank of the anchor when the main shank of the anchor is pulled firmly back along said rear section;

means mounted below said roller for engaging said anchor at another spaced location to restrain movement of said anchor; and means for providing relative movement to substantially change the distance between said roller and said anchor engaging means to firmly secure Bruce anchors of several different sizes in said assembly;

whereby said assembly facilitates the raising and lowering of the anchor, and firmly secures Bruce anchors of a series of different sizes, with fluke or palm area engaged by said protrusions and both the longer and shorter portions of said shank engaged by said roller so that the anchor is held against rolling or vibrating under conditions of movement or vibration.

9. An assembly as defined in claim 8 wherein means are provided for movably mounting said pulley relative to said anchor engagement means.

10. An assembly as defined in claim 8 wherein said anchor engaging means includes means for restraining said anchor against vertical movement.

11. An assembly as defined in claim 8 wherein said anchor engaging means includes means for restraining said anchor against rocking movement.

* * * * *